US005454549A

United States Patent [19]

Ten Dam

[11] Patent Number: 5,454,549

[45] Date of Patent: Oct. 3, 1995

[54] SPRING DEVICE

[75] Inventor: Paul J. Ten Dam, Veenendaal, Netherlands

[73] Assignee: Kämpfer; Hans-Peter, Germany

[21] Appl. No.: 143,566

[22] Filed: Oct. 26, 1993

[30] Foreign Application Priority Data

Oct. 26, 1992 [NL] Netherlands ..... 92.01857

[51] Int. Cl.[6] ..... F16F 5/00

[52] U.S. Cl. ..... 267/119; 267/130; 72/453.15

[58] Field of Search ..... 72/351, 453.15; 267/118, 119, 130; 188/282, 285, 287, 288

[56] References Cited

U.S. PATENT DOCUMENTS

| | | | |
|---|---|---|---|
| 1,967,245 | 7/1934 | Hothersall | 72/351 |
| 2,143,429 | 1/1939 | Auble | 72/351 |
| 3,267,715 | 8/1966 | Williamson | 72/351 |
| 3,420,089 | 1/1969 | Myers | 72/351 |
| 4,121,449 | 10/1978 | Celi | 72/500 |
| 4,745,792 | 5/1988 | Story et al. | 72/351 |
| 4,873,859 | 10/1989 | Bulso, Jr. et al. | 72/351 |

FOREIGN PATENT DOCUMENTS

| | | |
|---|---|---|
| 1481202 | 7/1977 | United Kingdom . |
| 2200862 | 8/1988 | United Kingdom . |

*Primary Examiner*—Robert J. Oberleitner
*Assistant Examiner*—Chris Schwartz
*Attorney, Agent, or Firm*—Webb Ziesenheim Bruening Logsdon Orkin & Hanson

[57] ABSTRACT

Disclosed is a spring device which, during use in co-action with a deep-drawing device, is capable of causing the blank-holder pressure to decrease in proportion to the remaining material. The spring device holds substantially constant the blank-holder force per unit of surface area on the non-deformed material and is considered a "degressive" spring wherein the reaction force exerted by the spring decreases as the displacement between the ends of the spring increases.

11 Claims, 7 Drawing Sheets

FIG.6
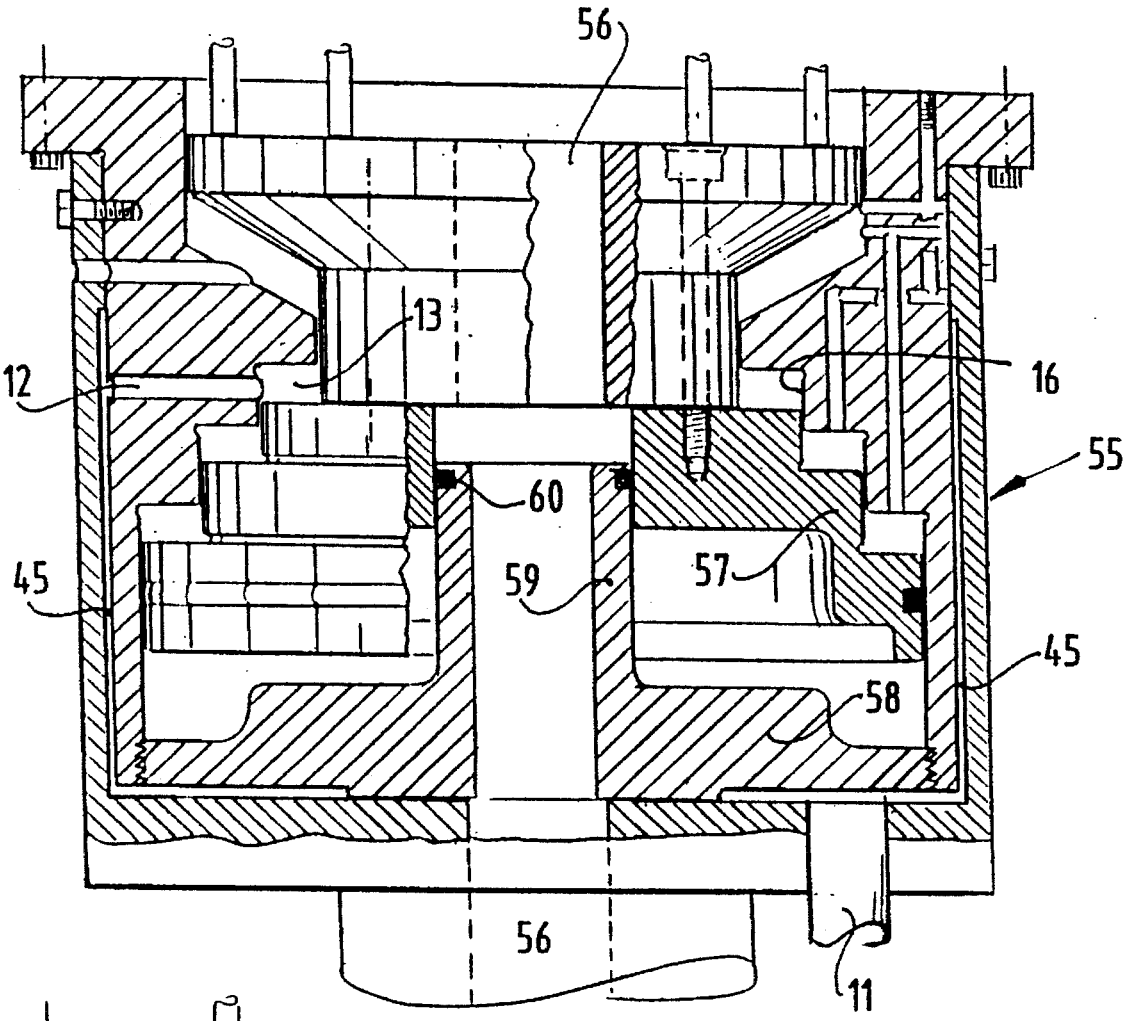
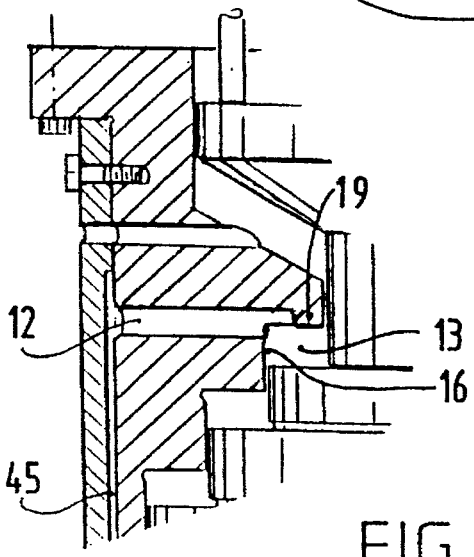
FIG.7

SPRING DEVICE

The invention relates to a spring device comprising a first housing partly bounding a first space and a first piston which is movable in a substantially sealing manner in an axial direction in this first space and which is fixedly connected to a piston rod extending in an axial direction which co-acts substantially sealingly with a first continuous hole in an end wall of the housing, which first piston divides the said first space into two chambers.

Such a device embodied as a spring device is generally known. In the known spring device both chambers are filled with medium under pressure, for instance 10–100 bar. Because the piston is provided with a continuous hole the same pressure prevails in both chambers. As a result of the difference in projected effective surface area of both sides of the piston, the piston is pressed under all conditions by the medium pressure to the side of the piston rod. Since the medium pressure and the relevant areas are constant, the spring force produced by the spring device is also constant over the whole active stroke.

In a drawing or deep-drawing operation, as is generally known, the blank-holder pressure per unit of surface area on the material still to be drawn increases during the deep-draw process. The increasing load per unit of surface area has two causes:

a) the material surface situated between the blank-holder and the deep-drawing tool becomes smaller, and b) during the use or a spring or other progressively acting medium the reaction force increases during the deep-draw process.

The said causes a) and b) provide a greatly increasing blank-holder pressure on the still present material for treating, which results in an undesired material deformation, damage to the material surface, breakage and an irregularly formed rim with four protrusions, so-called ears, which occur at four locations, this at 45° to the rolling direction of the material.

In order to prevent as far as possible the drawback under point b) use is sometimes made of a non-progressive spring device and in very exceptional cases use is made of a very slow-acting and complicated servo-control system to regulate the bending machine pressure. This latter solution cannot be applied in practice in combination with fast-action production units.

The invention has for its object to provide a spring device which, during use in co-action with a deep-drawing device, is capable of causing the blank-holder pressure to decrease in proportion to the still remaining material. It is particularly the object to hold substantially constant the blank-holder force per unit of surface area on the as yet non-deformed material.

The invention generally has for its object to embody a spring device of the said type such that it can be considered a "degressive" spring. Such a spring, be it either a draw spring or compression spring, is defined by the fact that the reaction force exerted by the spring decreases as the displacement between the ends of the spring increases.

In order to realize the above stated objective the spring device according to the invention has the feature that a feed conduit for feeding medium under pressure connects to each of both chambers, at least one of the chambers is embodied as a number of chamber parts forming a closed contour, mutually connecting in step-shaped manner and each having an axial peripheral wall, which chamber parts are bounded axially by successive transverse walls and successive axial peripheral walls of increasing axial lengths, wherein the first piston has a corresponding form and wherein the relevant feed conduit debouches into the chamber part with the smallest cross sectional surface area on the transverse wall, close to this transverse wall on the axial peripheral wall or in the transition zone between the transverse wall and the axial peripheral wall, a medium drain conduit debouches on the relevant transverse wall close to this transverse wall on the axial peripheral wall or in the transition zone between the transverse wall and the axial peripheral wall, and valve means are present which only unblock the respective medium drain conduits in a position wherein the connection between the relevant chamber part and the adjoining chamber part is wholly Or practically wholly blocked by the first piston.

The said valve means can be linked to the action of the spring device by means of synchronization provisions. An embodiment is however recommended in which the valve means comprise:

a cup-shaped second housing partly bounding a second space and fixedly coupled to the first housing, and a second piston which is slidable in a substantially sealing manner in this second space and which is fixedly connected to the piston rod which co-acts sealingly with a second continuous hole in a wall of the second housing, which second space is connected to a conduit for free draining of medium, the respective drain conduits in the second space at relative positions corresponding with the mutual differences between the axial lengths of the said axial peripheral walls, and the second piston has an axial length such that in the one extreme position in which the said of both chambers has its smallest volume it unblocks all drain conduits and in the other extreme position in which the said of both chambers has its largest volume it blocks all drain conduits.

This embodiment can be of very compact and simple structure and have for this purpose the feature that the first housing and the second housing are integrated and are separated by a dividing wall, that the first piston, the second piston and the piston rod are integrated and that both continuous holes are formed by one continuous hole in the dividing wall.

Separate pressure medium feed conduits can connect to the first and the second chamber. This ensures very great flexibility in the choice of the spring characteristics. A simple embodiment which lacks this flexibility but which is of somewhat simpler construction is characterized by a bypass conduit which connects the smallest of the said chamber parts to the other chamber.

In such a spring device the same medium pressure always prevails on both sides of the piston, as in any known gas spring. Such a spring is nevertheless of degressive type since the active surface area is dependent on the position which the first piston occupies in the first housing.

It may be desired to cause the return of the piston to take place at controlled speed- For this purpose the spring device according to the invention can have the feature that the conduit for free draining of medium comprises an element with adjustable passage.

The lower chamber and associated portion of the piston have in cross section a stepped, complementary structure. In the situation where the relevant step-shaped chamber has its minimum volume, in particular a zero volume, the axial surfaces of the chamber parts forming a closed contour substantially seal against the oppositely located axial surfaces of the piston which form a closed contour. In this manner a separation between the respective active chamber parts is ensured. When medium under pressure is being admitted into the smallest chamber part via the relevant medium feed conduit, some medium under pressure could already be admitted into the following chamber part or the following chamber parts. This does not have to have an adverse effect on the operation of the spring device but does mean that only limited demands need be made on the seal between the different chamber parts. From a production technique viewpoint this can be very advantageous, while moreover the risk of wear, premature ageing and disturbances is greatly reduced. A spring device which realizes these objectives has the feature that the axial peripheral wall of each chamber part has a small clearance relative to the corresponding axial peripheral walls of the piston.

From the point of view of production technique the simplest spring device is one having the feature that the chamber parts are bounded by surfaces extending transversely of the axial direction.

It may be desirable in some conditions for the sprang device according to the invention to lend itself to through-feed of machine components. An embodiment suitable for this purpose has the feature that the spring device has a continuous hole extending in axial direction and that the first piston co-acts in sealingly slidable manner with that hole.

In the case the spring device is used in a deep-draw process, to which the invention is not limited, the following advantages have been observed:

(a) The formation of "ears" is greatly reduced.

(b) The decrease in material thickness at the position of rough edges is wholly avoided.

(c) Pre-applied coatings such as lacquer and the like are no longer damaged during the deep-draw process.

Secondary advantages are:

a. The possibility of increasing the deep-drawing ratio.

b. A better material through-flow during use in combination with complicated tool product forms, rectangular, polygonal, non-round and relief.

c. Material saving: due to the negligible formation of rough edges, little extra material is needed which has to be trimmed in a later process stage.

e. A greater efficiency is obtained due to a considerable reduction in the contamination of the deep-draw tool by material splinters and lacquer particles.

f. Special requirements to be made of the deep-draw material can be partially eliminated.

The invention will now be elucidated with reference to the annexed drawing, wherein:

FIG. 6 shows partly in cross section and partly in broken away side view a gas spring with a continuous hole in two respective operating positions;

FIG. 7 shows a detail of a variant of the gas spring according to FIG. 6;

Figure 8D:
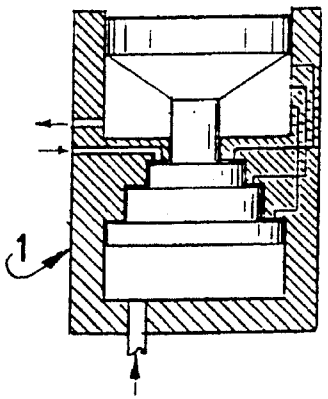
Figure 8D:
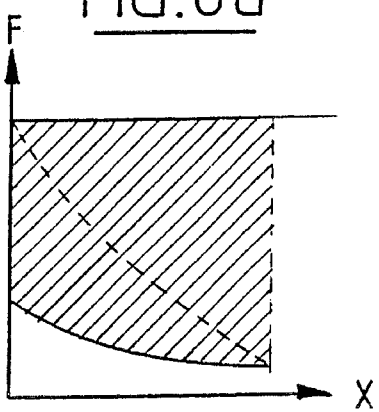
Figure 8C:
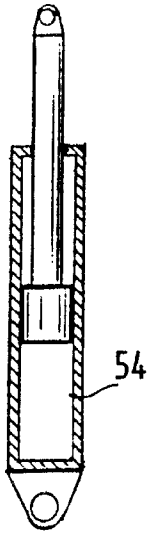
Figure 8C:
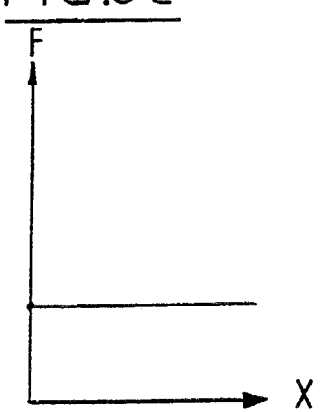
Figure 8B:
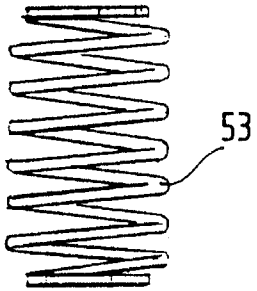
Figure 8B:
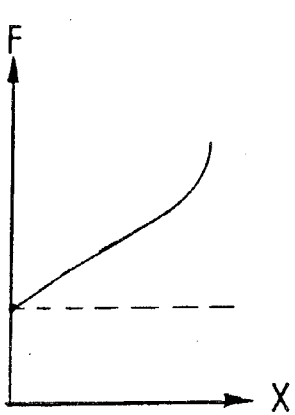
Figure 8A:
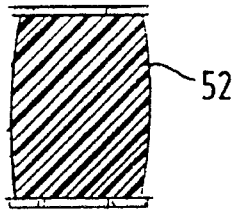
Figure 8A:
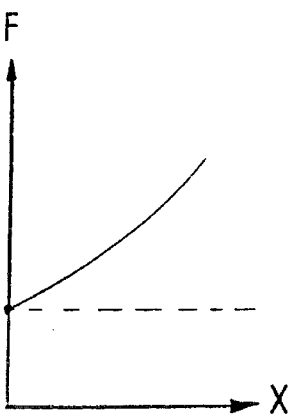
Figure 9:
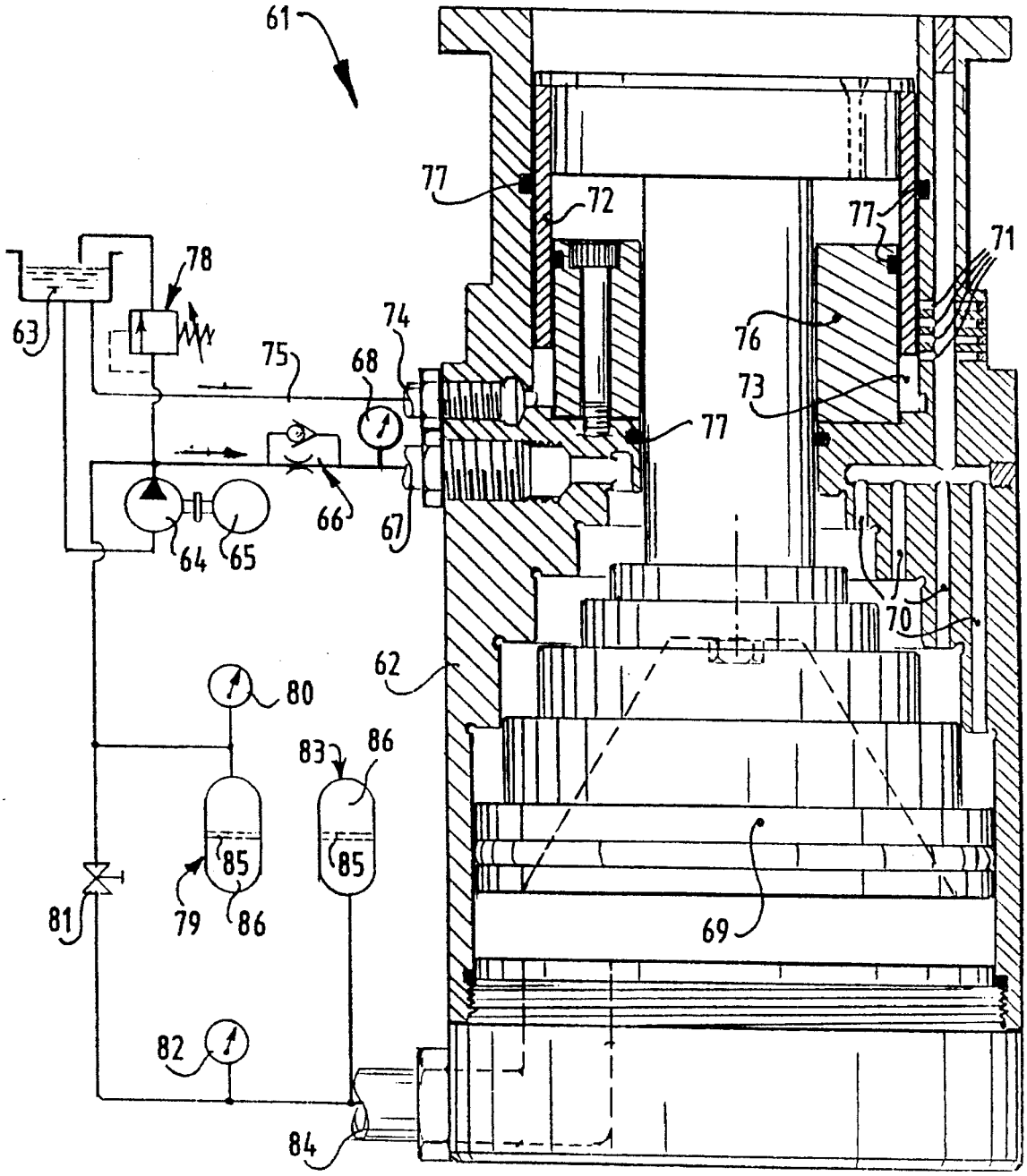

FIG. 8*a* shows schematically a known rubber spring with associated characteristic;

FIG. 8*b* shows schematically a known spiral spring with associated characteristic:

FIG. 8*c* shows schematically a known gas spring with associated characteristic;

FIG. 8*d* shows schematically the degressive spring according to the invention with a graphic illustration of the range within which the spring characteristic can be freely adjusted at the wish of the user; and FIG. 9 shows a cross section through a spring device according to the invention which operates with liquid medium under pressure.

Figure 1:
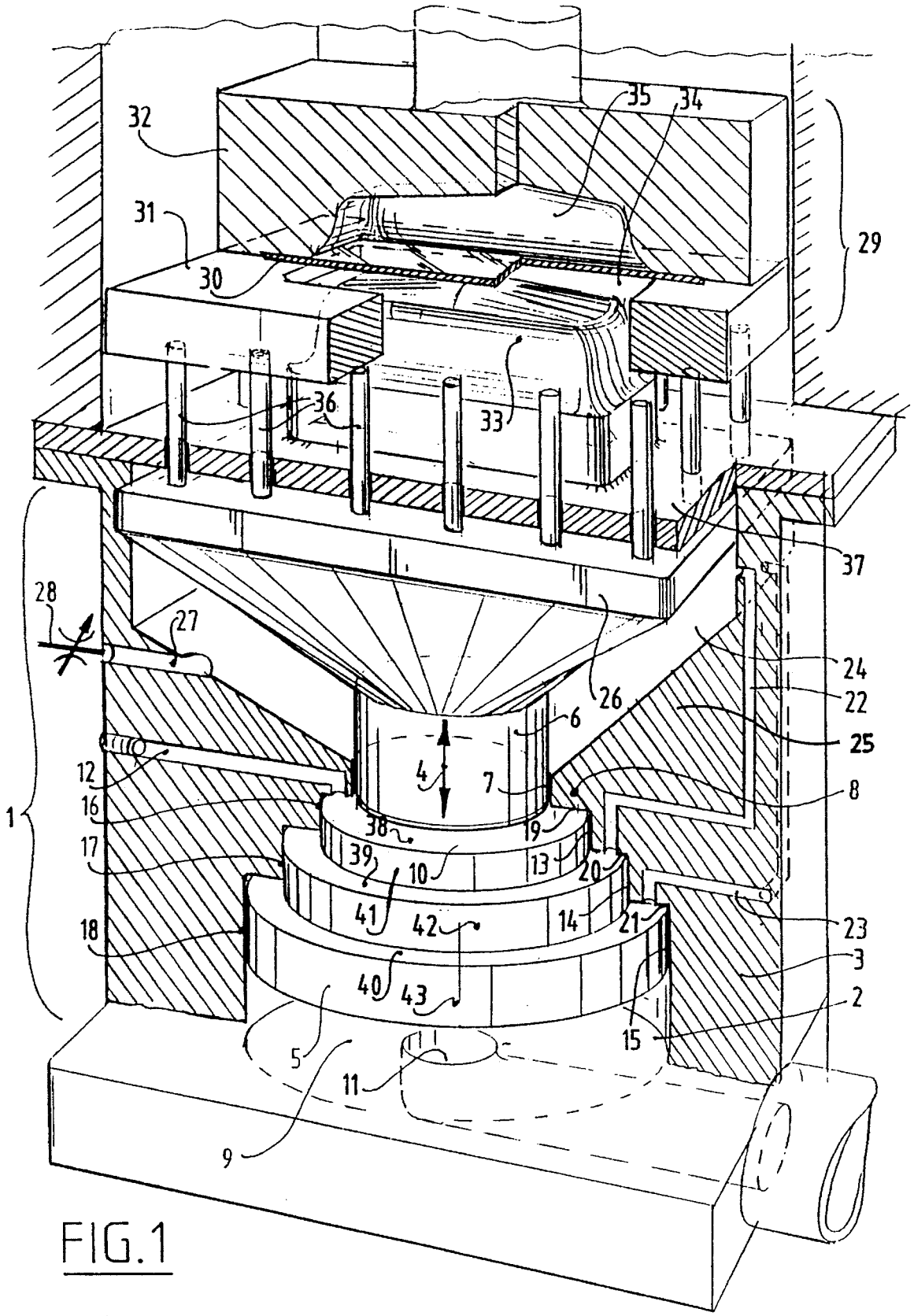
FIG. 1 shows a cut away perspective view of a gas spring in a first embodiment.

FIG. 1 shows a degressive gas spring 1 in a first embodiment according to the invention. Gas spring 1 comprises a first housing 3 partly bounding a first space 2 and a first piston 5 which is movable in substantially sealing manner in an axial direction 4 in this first space 2 and which is fixedly connected to a piston rod 6 which extends in an axial direction and which co-acts substantially sealingly with a continuous hole 7 in an end wall 8 of the first housing 3, which first piston 5 divides the said first space 2 into two chambers, namely a lower chamber 9 and an upper chamber 10.

A first feed conduit 11 for medium under pressure connects onto the lower chamber 9. A second feed conduit 12 for medium under pressure connects onto the upper chamber 10.

The upper chamber 10 is embodied as three chamber parts 13, 14, 15 respectively forming a closed contour, mutually connecting in step-shaped manner and each having an axial peripheral wall 16, 17, 18 respectively, which chamber parts 13, 14, 15 are axially bounded by successive transverse wall portions 19, 20, 21 respectively (which in this embodiment are oriented perpendicularly of the axial direction 4) with increasing surface areas, wherein the successive axial peripheral walls 16, 17, 18 have increasing axial lengths. The first piston 5 has a corresponding form. The feed conduit 12 debouches on wall portion 19, that is the wall portion which adjoins the piston rod 6 and has the smallest cross sectional surface area.

First and second medium drain conduits 22, 23 respectively, connect onto the respective wall portions 20 and 21. These debouch into a second space 24 which is bounded by a second housing 25 formed integrally with the first housing 3 and having a general cup shape. A second piston 26 is slidable substantially, in any case more or less, sealingly in the second space 24. The second piston 26 is carried by the piston rod 6. Connecting onto the second space 24 is an exhaust conduit 27 for free draining of medium out of the second space 24.

The medium drain conduits 22 and 23 debouch into the second space 24 at relative positions in accordance with the mutual differences between the axial lengths of the said axial peripheral walls 16, 17 and 17, 18. The second piston 26 has an axial length, that is, a length along which it co-acts sealingly with the edge of the second space 24, such that in a first position the upper chamber 10 has its smallest volume and the second piston 26 unblocks both medium drain conduits 22, 23 and in a second position the upper chamber 10 has its largest volume and the second piston 26 blocks both medium drain conduits 22, 23.

The second piston 26 forms valve means whereby the movement of the second piston 26 through a whole active stroke either opens or obstructs the medium drain conduits 22,23. Medium may pass through either medium drain conduit 22,23 when then corresponding chamber part 14,15 and an adjoining chamber part are not in fluid connection. The second piston 26 blocks the medium drain conduits 22,23 when the corresponding chamber part 14,15 and an adjoining chamber part are in fluid connection. An element 28 with an adjustable passage is arranged in the exhaust conduit 27.

The peripheral walls 16, 17, 18 have a small clearance relative to the corresponding axial peripheral walls of the first piston 5.

The second housing 25 supports a deep-drawing device 29. A metal plate 30 is inserted between the edges of two mould parts 31, 32. Mould part 31 has a continuous hole 34 for passage of a third mould part 33 which has a form corresponding with the desired form of a deep-drawn plate. The second mould part 32 has a correspondingly formed cavity 35. Through relative displacement of mould parts 32 and 33 the metal plate 30 clamped between mould parts 31 and 32 is pressed against the bottom of the mould cavity 35 by the mould part 33. During this deep-draw process a relatively downward directed force is exerted on mould part 32 which is transferred via force transmitting pins 36 (which extend through a dividing wall 37) onto the second piston 26, whereby the first piston 5 of gas spring 1 is pressed downward.

By means of unillustrated means medium under pressure is fed via the first feed conduit 11 and the second feed conduit 12 to respectively the lower chamber 9 and the upper chamber 10. In the uppermost position drawn in this figure the first piston 5 still closes off the second feed conduit 12 entirely. When the first piston 5 is displaced in downward direction a pressure Is exerted by the relevant medium on the upper flat surface 38 of piston 5. The reaction force applied by gas spring 1 hereby decreases. As displacement continues medium pressure is also exerted on the second flat surface 39 of the piston, which causes further reduction of the reaction force applied by gas spring 1. With still further displacement the third flat surface of the pistons 5 is also loaded by medium pressure whereby the smallest possible reaction force remains.

After the gas spring has thus been moved from the first position shown in FIG. 1 to the second position in which the upper chamber 10 has its maximum volume, it must be returned to the starting position. The pressure in the lower chamber 9 carries back the first piston 5, wherein medium can first escape from the chamber part 15 via the second medium drain conduit 23 to the second space 24 to then be drained via exhaust conduit 27. For this purpose the second piston 26 has meanwhile been displaced into a position in which it unblocks the debouchment of said conduit 23 into space 24. Draining of medium from chamber part 14 subsequently takes place via the first medium drain conduit 22 which has meanwhile been unblocked by the second piston 26.

The draining of medium from chamber part 13 does not require an extra conduit, since this chamber part is connected via the conduit 12 to a source of medium under pressure.

Due to the presence of the element 28 with adjustable passage, the speed at which gas spring 1 is reset can be adjusted in accordance with the wishes of the user. At the beginning of a following Work stroke the pressure in the second space 24 must again be atmospheric.

It is important to note that owing to the cyclic ventilation of the chamber parts 13, 14, 15 a very good cooling is obtained.

It will further be apparent that the spring characteristic realized is dependent on the dimensioning of the gas spring and the pressure of the medium fed via the first and second feed conduits 11, 12, respectively. It has been found in practice that practically any desired degressive characteristic can be realized with a sufficient degree of accuracy and reproducibility.

As a result of the fact that the axial peripheral walls 16, 17, 18 connect with some clearance onto the corresponding axial peripheral walls 41, 42, 43 of the first piston 5, pressure medium admitted into the chamber part 13 can to a limited extent already flow through to chamber part 14. Medium can then flow smoothly out of chamber part 14 to chamber part 15. This can further a smooth, i.e. non-jerky, operation of the gas spring. The speed of the piston also contributes to this smooth action.

Pig. 2 shows a gas spring 44 with the deep-drawing device 29. The structure of gas spring 44 differs from the embodiment of FIG. 1 only in the presence of bypass conduit 45 which connects the lower chamber 9 to the upper chamber 10. The same medium pressure hereby always prevails in these two chambers 9, 10. This limits the adjustability of the spring characteristic.

Figure 2:
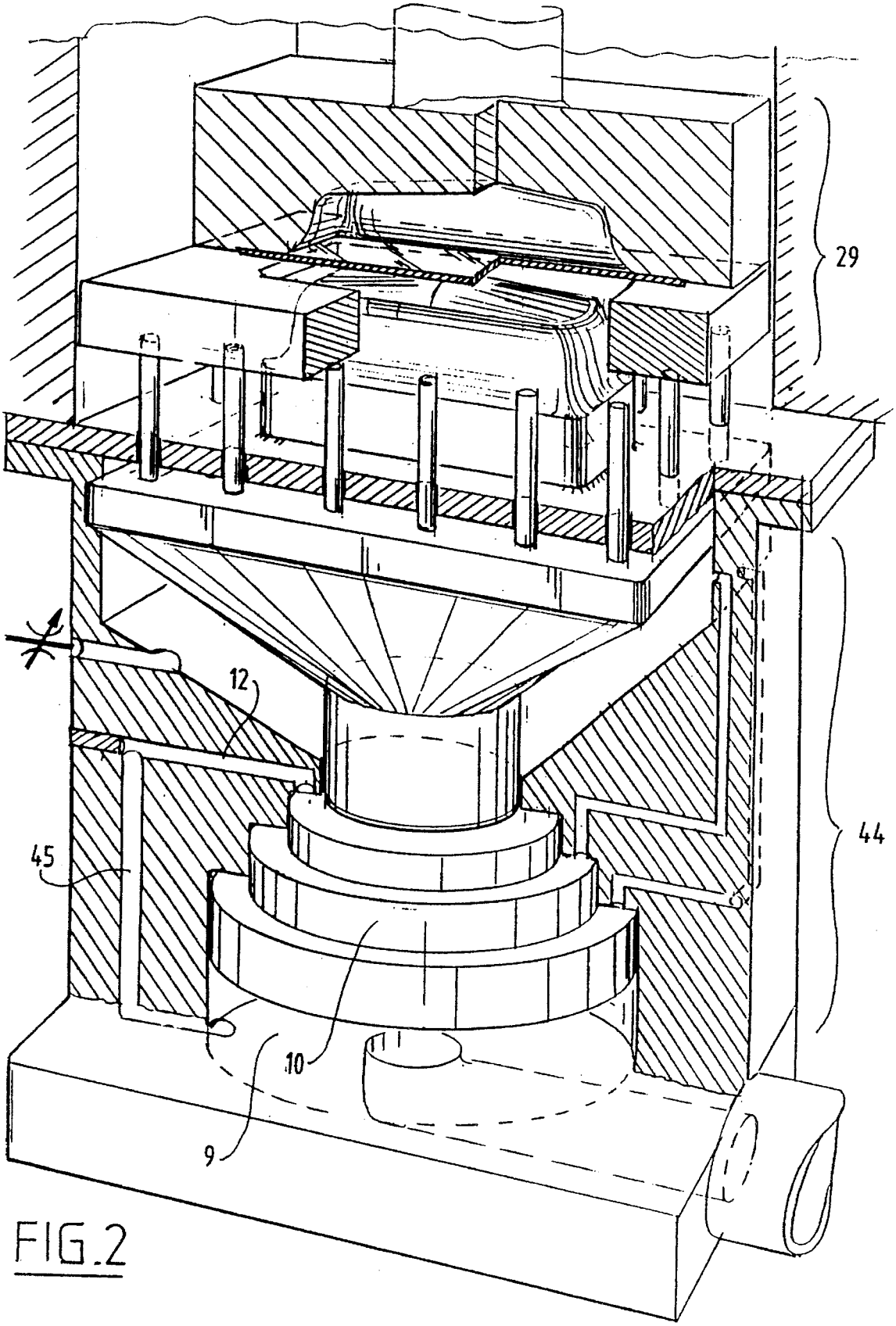
FIG. 2 shows a view corresponding with FIG. 1 of a second embodiment.
Figure 3:
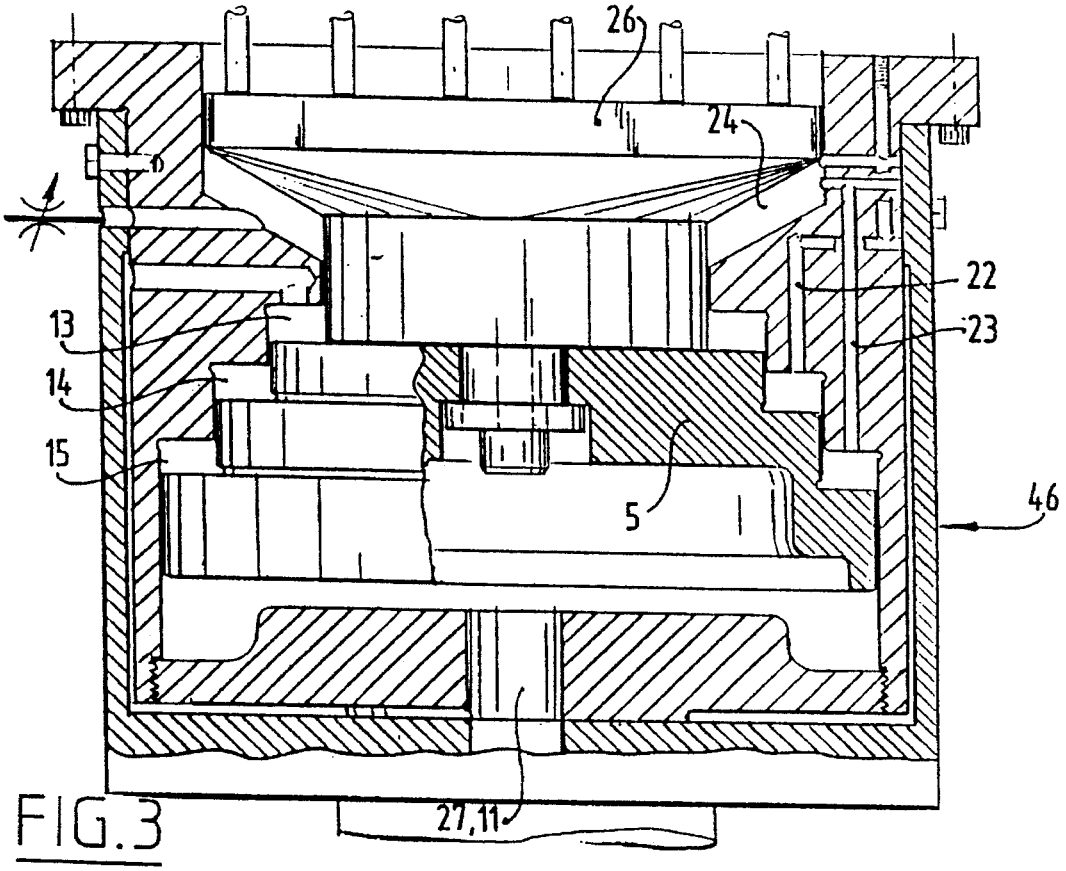
FIG. 3 and 4 are cut away side views of a third embodiment in different positions.
Figure 4:
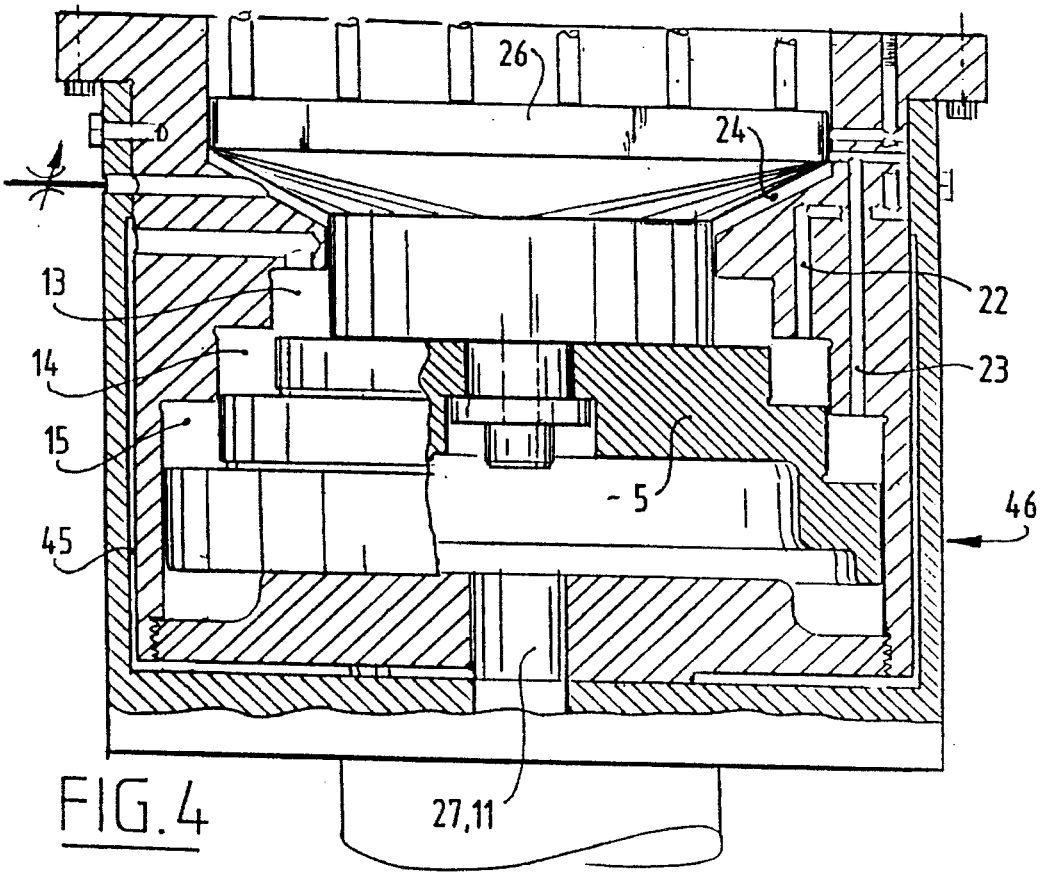

FIG. 3 and 4 show a gas spring 46 in two positions. For the sake of simplicity elements corresponding functionally with the elements of FIG. 1 and 2 are designated with the same reference numerals as in the discussion of FIG. 1 and FIG. 3 shows clearly that in the situation where the chamber part 13 is active and the chamber part 14 is on the point of becoming active, the debouchment of the first medium drain conduit 22 into the second space 24 is on the point of being closed by the piston 26.

FIG. 4 shows that in the position wherein, after chamber part 14, chamber part 15 also becomes active, the debouchment of the second medium drain conduit 23 into the second space 24 is also blocked by the piston 26.

Figure 5:
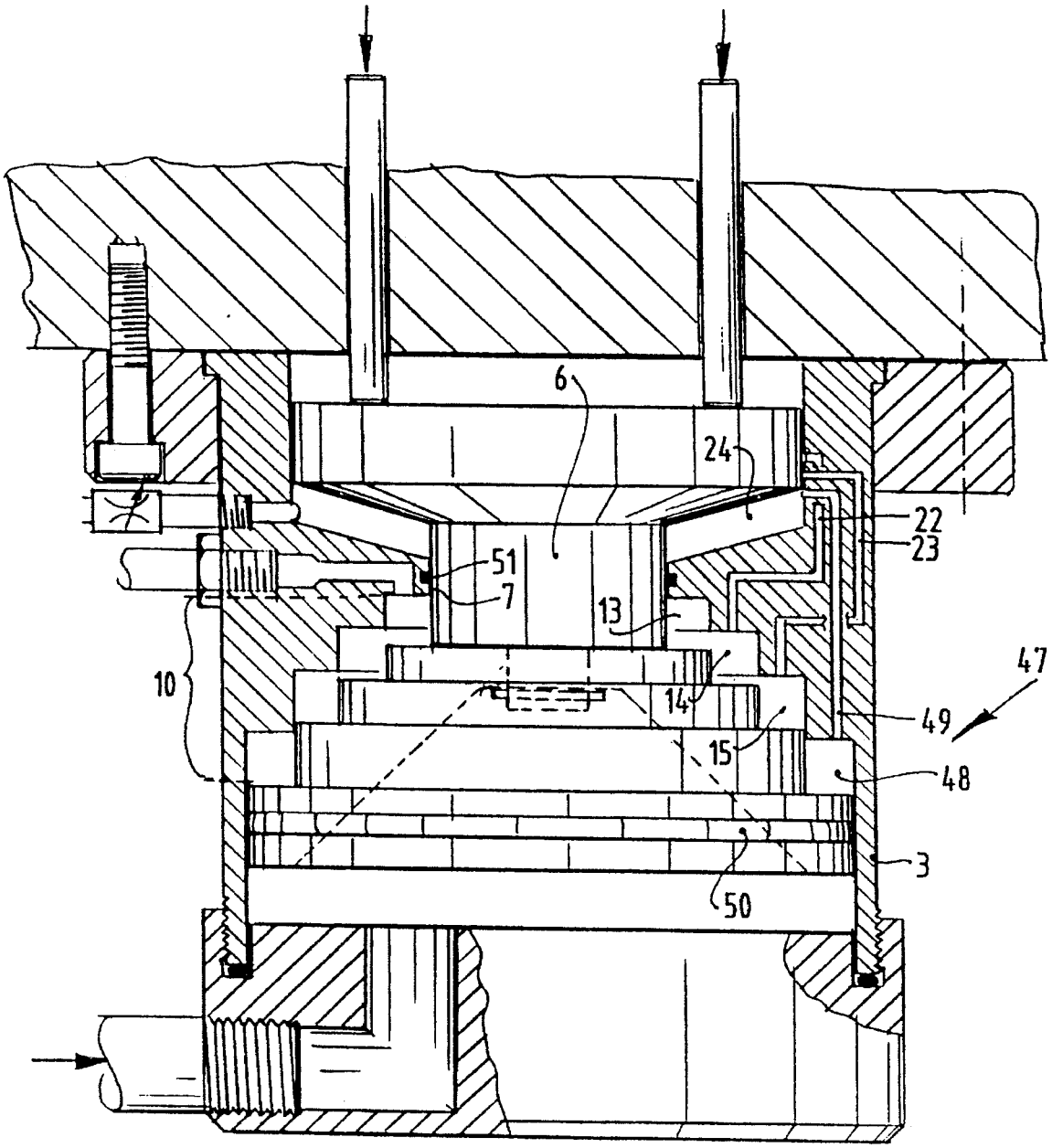
FIG. 5 is a cut away side view of a fourth embodiment.

FIG. 5 shows a gas spring 47 in which the upper chamber 10 consists of four chamber parts, namely the chamber parts 13, 14, 15 in accordance with the above described embodiments having thereby an additional chamber part 48. This debouches via a third medium drain conduit 49 into the second space 24 below the debouchment of the second medium drain conduit 23.

It can be seen in this embodiment that the first piston 5 co-acts sealingly with the first housing 3 via a sealing ring 50. The piston rod 6 is also guided sealingly in the continuous hole 7 by a sealing ring 51.

FIG. 6 shows a gas spring 55 with a central continuous hole 56. In this respect the first piston 57 is sealingly slidable relative to this central hole continuous 56. Use is made for this purpose of a bottom part 58 with a central cylinder 59, which cylinder 59 co-acts with the first piston 57 by means of a sealing ring 60.

Functionally the gas spring 55 corresponds substantially with the gas spring 44 according to FIG. 2. It is however important to note that there are a number of differences which make it desirable to discuss this important embodiment. The bypass conduit 45 shown in FIG. 2 is implemented in this embodiment as a free space serving as a conduit. Other than in the embodiments 1 and 2, the second feed conduit 12 debouches on the peripheral wall 16 of the first chamber part 13. The gas spring 55 hereby acts in the first part of the stroke, in which the piston 57 still fully closes off the debouchment of the second feed conduit 12, as a normal gas spring. Only after the second feed conduit 12 has been partially unblocked does the degressive action according to the invention take place.

FIG. 7 shows a detail of a variant in which the second feed conduit 12 debouches into the chamber part with the smallest cross sectional surface area 13 in the transition zone between the flat transverse will portion 19 and the peripheral wall 16.

Attention is drawn to the fact that particularly in an embodiment as according to FIG. 6 the possibility exists of selecting the form of debouchment of the second feed conduit 12 into chamber part 13 with a view to a specific desired characteristic. Use can for instance be made of a more or less wedge-shaped outflow opening whereby medium can be admitted progressively to chamber part 13 via the second feed conduit 12.

FIG. 8 shows a comparison between three known springs and the degressive spring device according to the invention.

FIG. 8*a* shows a spring provided with a rubber block 52 with the associated spring characteristic. Shown vertically is the force, horizontally the compression of the spring. It is assumed in the characteristic that the spring has a certain bias.

FIG. 8*b* shows a normal spiral spring 53 with associated characteristic. The rubber block spring and the spiral spring have in common that the spring characteristics display a progressive nature.

FIG. 8*c* shows a typical gas spring 54. It can be seen from the spring characteristic that the compression force is substantially constant.

FIG. 8*d* shows schematically the gas spring 1 according to the invention. It can be seen from the accompanying characteristic that practically any spring characteristic can be realized inside the hatched section by suitable choice of the gas pressures in combination with the design of the dimensioning of the gas spring.

FIG. 9 shows a hydraulic spring device 61 of the degressive type. The above discussed FIGS. 1–7 all related to degressive spring devices based on the use of gas under pressure as medium. The spring device 61 is based on a liquid as medium. Since a liquid is non-compressible, means are necessary, otherwise than in the use of gas, to ensure that, as the pressure builds up, the liquid can escape where necessary in order to enable relative movement of the piston and the cylinder, while on the other hand means must also be present to build up and maintain this pressure, and particularly to hold it substantially constant during a work cycle.

The structure of the device 61 corresponds by and large with that as according to FIG. 1. It will therefore suffice to discuss a number of components which do not appear in FIG. 1.

A hydraulic system depicted in the form of a block diagram is connected to the cylinder-piston unit 62. Situated in a reservoir 63 is a liquid medium such as hydraulic oil, A pump 64 driven by a motor 65 brings the hydraulic oil to the pressure required for operation of the unit 63. The oil under pressure is supplied via a pressure regulator-regulating valve 66 to an inlet 67 of the unit 62. Monitoring of the pressure is carried out by a meter 68. The oil thus brought under pressure can act to exert pressure on the upper part piston 69, analogously to the foregoing discussion of the gas springs. For return of the oil to the reservoir 63 during upward directed movement of piston 69 use is made of four conduits which are grouped as a manifold and therefore designated jointly with the reference numeral 70. Via openings 71, which during displacement of the piston 69 are opened or closed selectively by a cylinder jacket-like valve member 72, the oil can flow back into a cylinder jacket-like space 73 which can carry the oil back to the oil reservoir 63 via a drain 74. It is noted that owing to the connections 67 and 74 the oil can flow in both directions subject to the movement condition of piston.

An insert pines 76 partly bounding the cylinder jacket-like space 73 limits the volume of the space 63, whereby the quantity of oil for displacement can remain comparatively limited, so that at higher speeds the danger of cavitations is prevented and the mass of oil to be displaced remains limited.

It is remarked that where necessary sealing rings are arranged. These are all designated with the reference numeral 77. Placed on the outlet of pump 64 is an overpressure safety control valve 78 which can return oil to the reservoir 63.

The outlet of pump 64 is also connected to a known pressure storage reservoir 79, a pressure gauge 80 and an adjustable tap 81 which in turn is connected to a pressure gauge 82, a second pressure reservoir 83 and a connection 84 on the underside of the cylinder/piston unit 62. Situated in reservoir 83 is an up and downward movable piston or a membrane 85 which is adjustably biased by nitrogen under pressure designated with the reference numeral 86. During normal use the valve 81 is closed. Should leakage occur somewhere in the system, whereby pressure loss or a shortage of oil occurs, the valve 81 is opened and oil under pressure is admitted into the system as required.

I claim:

1. A spring device comprising a first housing partly bounding a first space, and a first piston which is movable in a substantially sealing manner in an axial direction in this first space, with the first piston fixedly connected to a piston rod extending in an axial direction which co-acts substantially sealingly with a first continuous hole in an end wall of the first housing, and the first piston divides the first space into an upper chamber and a lower chamber, wherein a first feed conduit for feeding medium under pressure is connected to the lower chamber and a second feed conduit for feeding medium under pressure is connected to the upper chamber, at least one of the chambers is embodied as a plurality of chamber parts forming a closed contour and mutually connected in a step-shaped manner, with the chamber parts having an axial peripheral wall and bounded axially by successive transverse walls and successive axial peripheral walls of increasing axial lengths, wherein the first piston has a corresponding form and the second feed conduit debouches into a chamber part with a smallest cross sectional surface area, and a plurality of medium drain conduits debouch into the remaining chamber parts, and including valve means for unblocking each medium drain conduit when a connection between a corresponding chamber part and an adjoining chamber part is blocked by the first piston.

2. The spring device of claim 1, wherein the valve means include a cup-shaped second housing partly bounding a second space and fixedly attached to the first housing, and a second piston which is slidable in a substantially sealing manner in the second space and which is fixedly connected to the piston rod which co-acts sealingly with a second continuous hole in a wall of the second housing, with the second space connected to an exhaust conduit for free draining of medium, and wherein the plurality of medium drain conduits includes a first medium drain conduit add a second medium drain conduit connected to the second space at relative positions corresponding with the mutual differences between the axial lengths of the axial peripheral walls, and the second piston is movable between a first position where the upper chamber has its smallest volume and a second position where the upper chamber has its largest volume, with the second piston having an axial length such that it unblocks the first add second medium drain conduits when the second piston is in the first position and it blocks the first and second medium drain conduits when the second piston is in the second position.

3. The spring device of claim 2, wherein the first housing and the second housing are integrated and are separated by a dividing wall, add the first piston, the second piston and the piston rod are integrated, and the first continuous hole and the second continuous hole are formed by one continuous hole in the dividing wall.

4. The spring device of claim 2, wherein the exhaust conduit for free draining of medium includes an element with adjustable passage.

5. The spring device of claim 1, wherein a bypass conduit connects the chamber part with the smallest cross sectional surface area to the lower chamber.

6. The spring device of claim 1, wherein the axial peripheral wall of each chamber part has a small clearance relative to a corresponding axial peripheral wall of the first piston.

7. The spring device of claim 1, wherein the chamber parts are bounded by a plurality of surfaces extending transversely of the axial direction.

8. The spring device of claim 1, further including a central continuous hole extending in an axial direction and the first piston co-acts in a sealingly slidable manner with the central continuous hole.

9. The spring device of claim 1, wherein the second feed conduit debouches into the chamber part with the smallest cross sectional surface area on the transverse wall.

10. The spring device of claim 1, wherein the second feed conduit debouches into the chamber part with the smallest cross sectional surface area on the axial peripheral wall close to the transverse wall.

11. The spring device of claim 1, wherein the second feed conduit debouches into the chamber part with the smallest cross sectional surface area in a transition zone between the transverse wall and the axial peripheral wall.

* * * * *

UNITED STATES PATENT AND TRADEMARK OFFICE

CERTIFICATE OF CORRECTION

PATENT NO. : 5,454,549
DATED : October 3, 1995
INVENTOR(S) : Paul J. Ten Dam

It is certified that error appears in the above-indentified patent and that said Letters Patent is hereby corrected as shown below:

Title page, in section '[73] Assignee:', "Kämpfer; Hans-Peter" should read --Hans-Peter Kämpfer--.

Column 1 Line 29 "use or" should read --use of--.

Column 2 Line 16 "Or" should read --or--.

Column 2 Line 61 "speed-" should read --speed.--.

Column 3 Line 23 "sprang" should read --spring--.

Column 4 Line 55 after "position" insert --,--.

Column 4 Line 57 after "position" insert --,--.

Column 5 Line 28 "Is" should read --is--.

Column 5 Line 58 "Work" should read --work--.

Column 6 Line 12 "Pig." should read --FIG.--.

Column 6 Line 22 after "and" insert --2.--.

Column 7 Line 49 "63." should read --62.--.

Column 7 Line 53 after "part" insert --of--.

Column 7 Line 65 after "piston" insert --69--.

UNITED STATES PATENT AND TRADEMARK OFFICE

CERTIFICATE OF CORRECTION

PATENT NO. : 5,454,549

DATED : October 3, 1995

INVENTOR(S) : Paul J. Ten Dam

It is certified that error appears in the above-indentified patent and that said Letters Patent is hereby corrected as shown below:

Claim 2 Line 62 Column 8 "add" should read --and--.

Claim 2 Line 3 Column 9 "add" should read --and--.

Signed and Sealed this

Thirtieth Day of January, 1996

*Attest:*

*Attesting Officer*

BRUCE LEHMAN

*Commissioner of Patents and Trademarks*